US006257706B1

(12) United States Patent
Ahn

(10) Patent No.: US 6,257,706 B1
(45) Date of Patent: Jul. 10, 2001

(54) MICRO INJECTING DEVICE AND A METHOD OF MANUFACTURING

(75) Inventor: Byung-Sun Ahn, Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/173,173

(22) Filed: Oct. 15, 1998

(30) Foreign Application Priority Data

Oct. 15, 1997 (KR) ..... 97-52822

(51) Int. Cl.[7] ..... B41J 2/04

(52) U.S. Cl. ..... 347/54; 347/63; 347/65; 347/56

(58) Field of Search ..... 347/63, 65, 54, 347/56; B41J 2/05

(56) References Cited

U.S. PATENT DOCUMENTS

| | | | | |
|---|---|---|---|---|
| 4,032,929 | | 6/1977 | Fischbeck et al. | 347/42 |
| 4,480,259 | | 10/1984 | Kruger et al. | 347/63 |
| 5,666,141 | | 9/1997 | Matoba et al. | 347/54 |
| 5,684,519 | | 11/1997 | Matoba et al. | 347/54 |
| 5,719,604 | | 2/1998 | Inui et al. | 347/54 |
| 6,074,043 | * | 6/2000 | Ahn | 347/54 |
| 6,126,272 | * | 10/2000 | Ahn | 347/54 |

* cited by examiner

*Primary Examiner*—John Barlow
*Assistant Examiner*—Blaise Mouttet
(74) *Attorney, Agent, or Firm*—Robert E. Bushnell, Esq.

(57) ABSTRACT

Disclosed is a micro-injection device, a method of manufacturing of the micro-injection device and method of use. The device comprises a liquid chamber separated from a working fluid chamber by an oscillating layer. The oscillating layer contains two regions: one having a high thermal expandibility and the other is a portion having a high impact transmittability. This structure gives the oscillating layer enhanced resistance against stress and enhances its performance. The device is particularly useful in ink-jet printing.

43 Claims, 11 Drawing Sheets

MICRO INJECTING DEVICE AND A METHOD OF MANUFACTURING

CLAIM OF PRIORITY

This application makes reference to, incorporates the same herein, and claims all benefits accruing under 35 U.S.C. § 119 from an application for MICRO INJECTING DEVICE AND A METHOD OF MANUFACTURING THE SAME earlier filed in the Korean Industrial Property Office on the 15$^{th}$ of October 1997 and there duly assigned Ser. No. 52822/1997.

BACKGROUND OF THE INVENTION

1. Field of the Invention

The present invention relates generally to processes and microdevices for the injection of liquids and, more particularly, to processes, structures and materials for the construction and use of devices for the injection of fluids into the body, or in injection of fluids such as lubricants into machinery.

2. Description of the Related Art

Micro-injection processes and processes, structures and materials for the construction and use of devices for the injection of fluids into the body, or in injection of fluids such as lubricants into machinery. With these processes a small device which is designed to provide a target, for example, printing paper, a human body, or a motor vehicle with a certain amount of a liquid phase of a substance, for example, ink, drug, or petroleum using the method in which a pulse of electric or thermal energy is applied to the above-mentioned liquid, changing the liquid's volume and thus supplying the liquid to a specific target.

Recent developments in electrical and electronic technology have led to rapid development of such micro-injection devices. These devices have applicability in a variety of applications, an a example being in ink-jet printing. Different from dot matrix printers, ink-jet printers are capable of printing with multiple colors and have advantages of reduced noise and enhanced printing quality. Ink-jet printers are currently gaining in popularity. Typically, an ink-jet printer includes a printer head with a plurality of nozzles each having a minute diameter. The printer head operates in response to application of electrical energy from an external source, heating the nozzles with the energy received, bubbling and expanding ink in the nozzles and spraying the ink onto a printing paper.

In one type of ink-jet printer head, the ink is driven from the ink chamber by an oscillating layer, which is a membrane separating the ink chamber from the chamber containing the working fluid. This type of inkjet printer head however, suffers from several problems. The oscillating layer, usually made of a uniform material such as nickel, undergoes considerable flexing in its operation. This causes strong tensile stress over the surface of the oscillating layer, and leads to tearing in the high stress regions. This tearing in turn can lead to folding of the oscillating layer, further degrading its performance. As a result, the oscillating layer can not respond to the vapor pressure changes in the working fluid chamber, and performance is greatly reduced.

Some examples of print heads of the contemporary art are shown, for example, in the following U.S. patents. U.S. Pat. No. 4,032,929, to Fischbeck et al., entitled High Density Linear Array Ink Jet Assembly shows an ink jet assembly with a flexible diaphragm driven by actuators. The diaphragm is notched to provide a hinge for the motion of the diaphragm. This diaphragm, or membrane, is not subjected to changes in temperature, however and would probably not be suitable for use in a thermal ink-jet print head. U.S. Pat. No. 4,480,259, to Kruger et al, entitled Ink Jet Printer with Bubble Driven Flexible Membrane has a flexible membrane that separates the ink chamber from the chamber containing the working fluid, and the membrane is driven by the expansion of the working fluid as the fluid is volatilized upon heating. It mentions a membrane of silicone rubber, which is subject to the tensile stresses described above. U.S. Pat. No. 5,684,519 to Matoba et al., entitled Ink Jet Head with Buckling Structure Body; describes an ink jet head with a plate that is mechanically buckled thereby pushing the ink. Such a plate is designed specifically for mechanical buckling, and is not designed to be driven by a working fluid in a thermal ink-jet print head. U.S. Pat. No. 5,666,141, to Matoba et al., entitled Ink Jet Head and a Method of Manufacturing Thereof describes an ink jet head with a plate which buckles upon electric heating, thereby driving the ink.describes an ink jet head with a plate that buckles upon heating to drive the ink. The plate described in this patent is designed to buckle with heat, providing the force which drives the ink, however, and the plate is not designed to be driven by the expansion of a working fluid. Moreover, the plate is not specifically designed to prevent stress to the plate. U.S. Pat. No. 5,719,604, to Inui et al., entitled Diaphragm Type Ink Jet Head Having a High Degree of Integration and a High Ink Discharge Efficiency also describes an ink jet head with a plate that buckles upon heating to drive the ink. The plate described in this patents is designed to buckle with heat, providing the force which drives the ink and the plate is not designed to be driven by the expansion of a working fluid. This plate is not specifically designed to prevent stress to the plate.

Based upon my observation of the art, I have discovered that what is needed, then, is an oscillating layer which is not susceptible to the stresses caused by flexing. Moreover, I have found that an improvement in the working response of the oscillating layer will also lead to improvement in performance of devices such as ink-jet print heads.

SUMMARY OF THE INVENTION

Therefore, it is an object of the present invention to provide an improved micro-injection device, and improved processes for making and using micro-injection devices.

It is another object to provide a micro-injection device with an oscillating layer that is resistant to damage due to the stress of flexing.

It is a still further object to provide a micro-injection device with an improved operating lifetime.

It is a yet further object to provide a micro-injection device with generally improved printing performance.

These and other objects may be achieved in the present invention by binarizing the structure of an oscillating layer, that is, making a flexible oscillating layer from a composite of layers defining two regions. One region is a portion of the oscillating layer having a high thermal expandibility, that is, a relatively high coefficient of expansion, and the other region is a portion having a high impact transmittability, that is, capable of delivering an impact to the ink. This provides a micro-injection device having a substrate, a protective layer formed on the substrate; a heating layer formed on the protective layer; an electrode layer formed in contact with the heating layer, conducting electrical signals; and a heating chamber barrier layer formed on the electrode layer so as to define a heating chamber in contact with the heating layer.

An oscillating layer is formed on the heating chamber barrier layer to expand and oscillate according to changes in the volume of a liquid filled in the heating chamber; a liquid chamber barrier layer is formed on the oscillating layer to define a liquid chamber in contact with the oscillating layer; and a nozzle plate is formed on the ink chamber barrier layer to define a nozzle in contact with the ink chamber. The oscillating layer may be constructed with a first expansion layer having a recessed portion arranged over the top edge of the heating chamber, and a second expansion layer formed in the recessed portion, dispersing the stress on the first expansion layer.

Preferably, the first expansion layer has a larger mass per unit area than the second expansion layer; and the second expansion layer has a larger thermal expansion coefficient, that is, the change in volume with change in temperature, than the first expansion layer. Preferably also, the first expansion layer is constructed with a structure of overlying layers of a first organic layer; a first contact layer formed on the first organic layer; a metal layer formed on the first contact layer; a second contact layer formed on the metal layer; and a second organic layer formed on the second contact layer. In this case, preferably, the first and second organic layers are formed of polyimide, the metal layer is formed of nickel and the first and second contact layers are formed of vanadium, titanium, chromium or other metal. In addition, preferably, the second expansion layer is formed of an organic material, more preferably, polyimide.

According to another aspect of the present invention, a method of manufacturing a microinjection device contemplates the steps of assembling an oscillating layer pre-formed through a second process on an assembly of a heating layer and a heating chamber barrier layer pre-formed during a first process to create a joined lower assembly; and assembling an assembly of a nozzle plate and a liquid chamber barrier layer pre-formed during a third process on the oscillating layer portion of the joined lower assembly.

The first process contemplates forming a heating layer on a first substrate including a protective layer formed on the substrate and forming an electrode layer in contact with the heating layer; and forming a heating chamber barrier layer on the electrode layer so as to define a heating chamber in contact with the heating layer. This forms a heating layer and heating chamber barrier assembly.

The second process contemplates the steps of forming a first expansion layer on a second substrate including a protective layer formed on the second substrate; patterning the first expansion layer to form a recessed portion in the first expansion layer; and forming a second expansion layer in the recessed portion. This forms an oscillating layer assembly.

The third process contemplates the steps of forming a nozzle plate including a nozzle on a third substrate including a protective layer formed on the third substrate; and forming a liquid chamber barrier layer including a liquid chamber on the nozzle plate. This forms a nozzle plate and liquid chamber barrier assembly.

The second process may include the steps of forming a protective layer on a substrate and forming a first organic layer on the protective layer; forming a first contact layer on the first organic layer, forming a metal layer on the first contact layer and forming a second contact layer on the metal layer. A second organic layer is formed on the second contact layer and a third contact layer is formed on the second organic layer. A structure of overlaying layers is patterned of the first contact layer, the metal layer, the second contact layer, the second organic layer and the third contact layer to form recessed portions, or grooves, and a second expansion layer is formed in the recessed portions.

The first organic layer may have a thickness within the range of approximately 1.5 to 2 $\mu$m. The first organic layer is dry-treated at a temperature within the range of between approximately 130 to 280° C. several times during a predetermined time interval. Preferably, the first organic layer is dry-treated two times at about 150° C. and about 200° C., respectively.

On the other hand, preferably, the first and second contact layers have a thickness within the range of between approximately 0.1 to 0.2 $\mu$m, more preferably, about 0.15 $\mu$m. In addition, preferably, the first and second contact layers have a surface resistance within the range of approximately 180 to 220 $\Omega/cm^2$, more preferably, about 200 $\Omega/cm^2$. The metal layer has a thickness within the range of approximately 0.2 to 0.5 $\mu$m, more preferably, about 0.3 $\mu$m.

On the other hand, preferably, the metal layer is vacuum-annealed. The vacuum-annealing may be performed at a temperature within the range of between approximately 150 to 180° C. In addition, preferably, the second organic layer has a thickness within the range of between 2 to 4 $\mu$m, more preferably, about 3 $\mu$m. In addition, preferably, the third contact layer has either a structure with overlying layers of chromium and copper or a single-layered structure of either chromium or copper. Preferably, the third contact layer has a thickness within the range of approximately 2 to 4 $\mu$m, more preferably, about 3 $\mu$m. The third contact layer has a surface resistance within the range of approximately 180 to 220 $\Omega/cm^2$, more preferably, about 200 $\Omega/cm^2$. Preferably, the second expansion layer has a thickness within the range of between approximately 1 to 3 $\mu$m, more preferably, about 2 $\mu$m.

Accordingly, the present invention is capable of remarkably improving the resistance against stress and the working response of the oscillating layer.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE DRAWINGS

Figure 1:
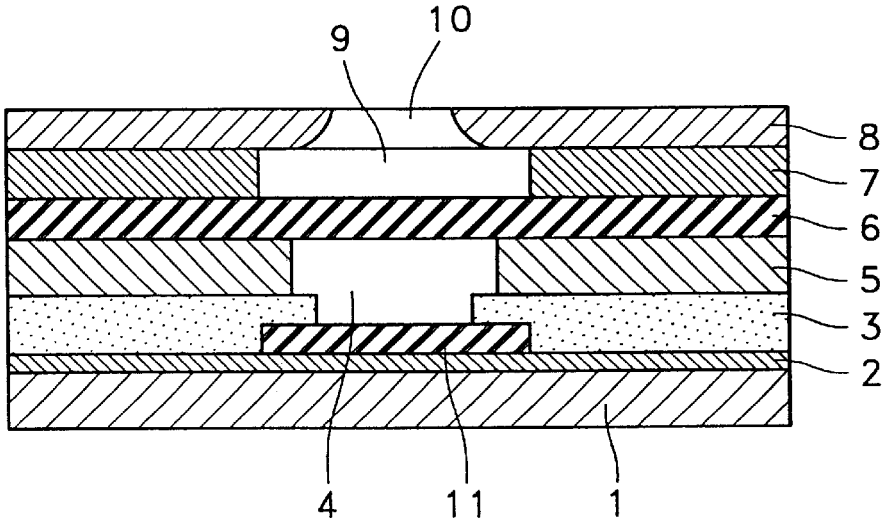
FIG. 1 is a schematic cross-sectional elevational view of an ink-jet printer head.
Figure 2:
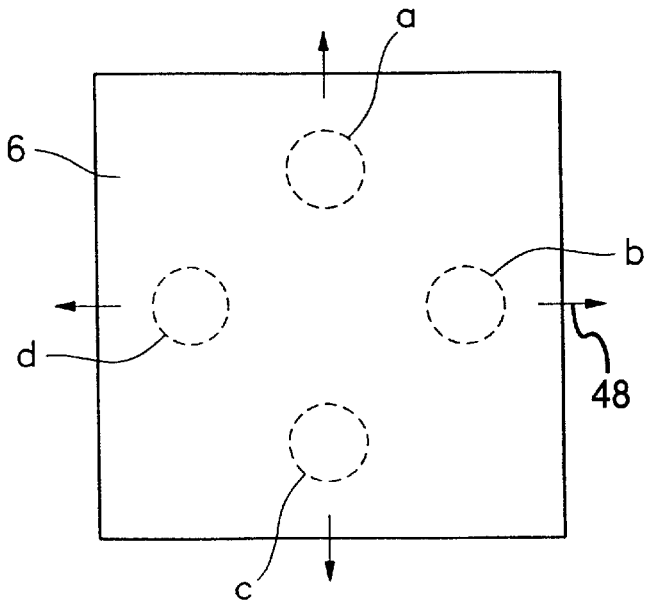
FIG. 2 is a schematic top view of the oscillating layer of FIG. 1.

Turning now to the drawings, and using an ink-jet printer head as a typical application that is representative of the fabrication and use of a micro-injection device, FIG. 1 is a schematic cross-sectional elevational view of an ink-jet printer head for ejecting ink and FIG. 2 is a schematic top view of oscillating layer 6 shown in FIG. 1. As shown in FIG. 1, this ink-jet printer head includes support substrate 1 including protective layer 2 formed on substrate 1 and resistor layer 11 formed on protective layer 2. Resistor layer 11 is heated by electric energy supplied from an external source through electrode layer 3 formed around the edge portions of resistor layer 11.

When electrified, resistor layer 11 converts the supplied electric energy into thermal energy at a temperature of 500 to 550° C. The converted thermal energy is transmitted into heating chamber 4 formed on electrode layer 3 by heating chamber barrier layer 5. A working liquid (not shown) that is easily volatilized fills heating chamber 4. The working liquid is rapidly gasified by the thermal energy transmitted from resistor layer 11 and the vapor pressure generated by the gasification of the working liquid is transmitted to oscillating layer 6 formed on heating chamber 4. As a result, oscillating layer 6 is expanded to an appropriate displacement and serves as is a membrane that flexes as the device operates. Oscillating layer 6 is uniformly formed of a material which allows rapid changes in the volume, for example, of nickel. Accordingly, as the vapor pressure is transmitted, oscillating layer 6 is rapidly expanded and flexed into a curved shape, whereby a strong expansion force is transmitted into ink chamber 9 formed on oscillating layer 6 by ink chamber barrier layer 7. A predetermined amount of ink is present within ink chamber 9. A displacement of the ink is caused by the impact of the expansion force transmitted from oscillating layer 6. As a result, a quantity of ink is expelled by the impact. The ink then passes through nozzle 10 perforating nozzle plate 8 and is discharged onto an external medium such as a cut sheet of paper, thus printing on the paper.

As mentioned, oscillating layer 6 in the print head of FIG. 1 is prone to experience structural and operational problems. First, oscillating layer 6 is uniformly formed of nickel or the like and expands during operation of the device by the vapor pressure transmitted from the working liquid in heating chamber 4. Then, a predetermined impact is applied to the ink within ink chamber 9, whereby an appropriate printing operation is performed on the external printing paper. As shown in FIG. 2, the changes in the volume are made over the entire surface of the oscillating layer 6, as is indicated by arrows 48.

In this case of the device of FIG. 1, a strong tensile stress is applied to the surface of oscillating layer 6. As a result, particular portions of oscillating layer 6, such as regions a, b, c and d in FIG. 2, can not resist the strong tensile stress and finally become torn due to the formation of tears, which can be of different sizes, that can lead in turn to folding of oscillating layer 6, ultimately degrading the performance of the entire ejection device. Furthermore, due to the tearing of portions a, b, c and d, the desired working response to the vapor pressure changes in the heating chamber 4 can no longer occur over all of oscillating layer 6. As a result, the general performance of the printer head is remarkably reduced.

Figure 4:
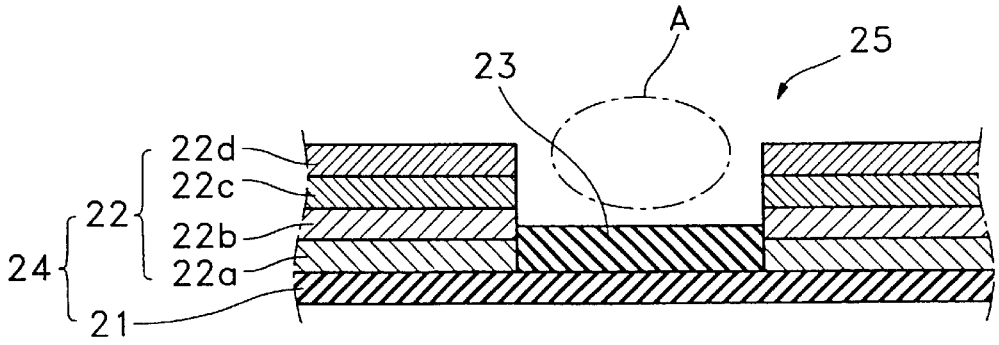
FIG. 4 is a schematic cross-sectional elevational view of an oscillating layer constructed according to the principles of the present invention.
Figure 5:
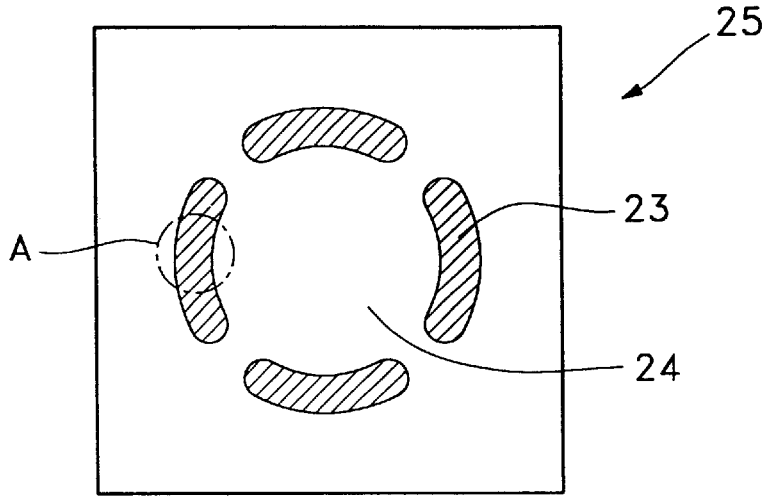
FIG. 5 is a top view of the oscillating layer shown in FIG. 4.

The micro-injection device of the present invention overcomes these shortcomings. It is noteworthy that such a device can be used for injecting different liquids. A preferred embodiment is as an ink-jet printer head, as shown in cross-sectional elevational view in FIG. 3. FIG. 4 is a schematic cross sectional view of oscillating layer 25 according to the present invention, and FIG. 5 is a top view of FIG. 4.

Figure 3:
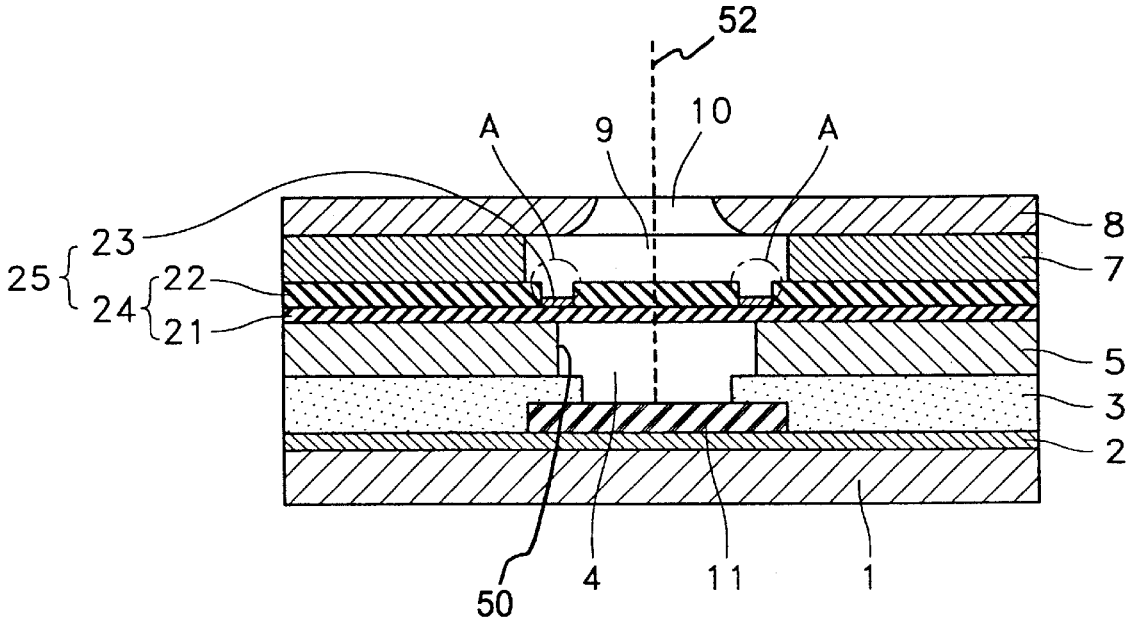
FIG. 3 is a schematic cross-sectional elevational view of an ink-jet printer head constructed according to the principles of the present invention.

As shown in FIG. 3, the ink-jet printer head according to the present invention includes substrate 1, including protective layer 2 formed thereon; heating layer, or resistor layer, 11 formed on protective layer 2 and electrode layer 3 formed in contact with heating layer 11. Heating chamber barrier layer 5 defines the wall or walls 50 of heating chamber 4 of which the resistor layer 11 and electrode layer 3 form the base. Wall 50 may be cylindrical, centered around axis 52.

On heating chamber barrier layer 5 is oscillating layer 25 which forms the top of the heating chamber. Oscillating layer 25 includes first expansion layer 24 formed over the top edge of heating chamber 4. First expansion layer 24 has grooves, or recessed regions, A, which are aligned with wall 50. Second expansion layer 23 is formed in grooves A. This arrangement serves to disperse stress on first expansion layer 24, as follows. Upon heating, rapid changes in the volume are made in first expansion layer 24. As a result, a strong impact is transmitted to a liquid filled in ink chamber 9 formed thereon. Second expansion layer 23 functions to appropriately disperse or remove the stress on the first expansion layer 24.

As shown in FIG. 4, first expansion layer 24 includes first organic layer 21 and organic membrane 22, which includes first contact layer 22*a* formed on first organic layer 21; metal layer 22*b* formed on first contact layer 22*a*; second contact layer 22*c* formed on metal layer 22*b*; and second organic layer 22*d* formed on second contact layer 22*c*.

First and second organic layers 21 and 22*d* are formed of an organic polymer, preferably a polyimide having high elasticity. Accordingly, the bottom and top of the first expansion layer 24 have an appropriate elasticity.

Particularly, second organic layer 22*d* allows adhesion of an ink chamber barrier layer 7 to first expansion layer 24. Generally, ink chamber barrier layer 7 is formed of polyimide. Since first expansion layer 24 has second organic layer 22*d* formed of the same material as ink chamber barrier layer 7, first expansion layer 24 can be firmly adhered to ink chamber barrier layer 7.

In addition, according to a feature of the present invention, metal layer 22*b* is formed of nickel which has a high thermal conductivity, a high elasticity and a high restoring force. Accordingly, rapid changes in the volume are made in first expansion layer 24 formed on heating chamber 4 according to vapor pressure occurrence associated with the gasification of a working liquid in heating chamber 4. As a result, the ink in the ink chamber 9 formed on heating chamber 4 can be rapidly pushed up to the nozzle.

First and second contact layers 22*a* and 22*c* are formed between first organic layer 21 and metal layer 22*b* and between metal layer 22*b* and second organic layer 22*d*, respectively so as to enhance the adhesion between them. Accordingly, first and second organic layers 21 and 22*d* and metal layer 22*b* are formed of different materials which can be firmly adhered to each other. Preferably, first and second contact layers 22*a* and 22*c* may be vanadium, titanium, chromium or other appropriate metal.

In addition, according to a feature of the present invention, second expansion layer 23 is formed of an organic material having a high elasticity and a high resistance against tensile strength. Accordingly, the stress concentrated on first expansion layer 24 on heating chamber 4 is dispersed and appropriately removed by second expansion layer 23.

In the ink jet print head of FIG. 1, a strong tensile stress is caused on the surface of the oscillating layer by expansion and oscillation of the oscillating layer and predetermined portions of the oscillating layer are torn and transformed, which results in reduced quality. However, in the present invention, as shown in FIG. 5, oscillating layer 25 includes first expansion layer 24 and second expansion layer 23 formed on grooves A formed in first expansion layer 24. In the embodiment shown in FIG. 5, grooves A are unconnected arcs having a certain width. The inner and outer edges of the grooves are aligned on circles which are concentric with each other and with axis 52. Accordingly, the stress on first expansion layer 24 is transmitted to second expansion layer 23 and then appropriately dispersed and removed. Thereby, deterioration of the oscillating layer can be prevented. Preferably, second expansion layer 23 is formed of polyimide.

Figure 6:
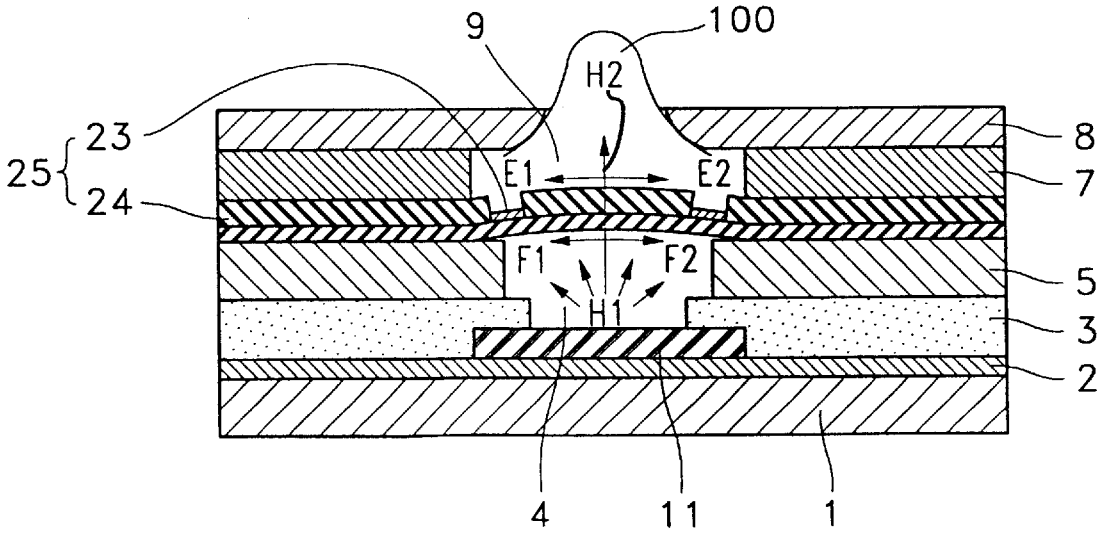
FIGS. 6 through 11 are schematic cross-sectional elevational views illustrating operation of an ink-jet printer head according to the principles of the present invention.
Figure 7:
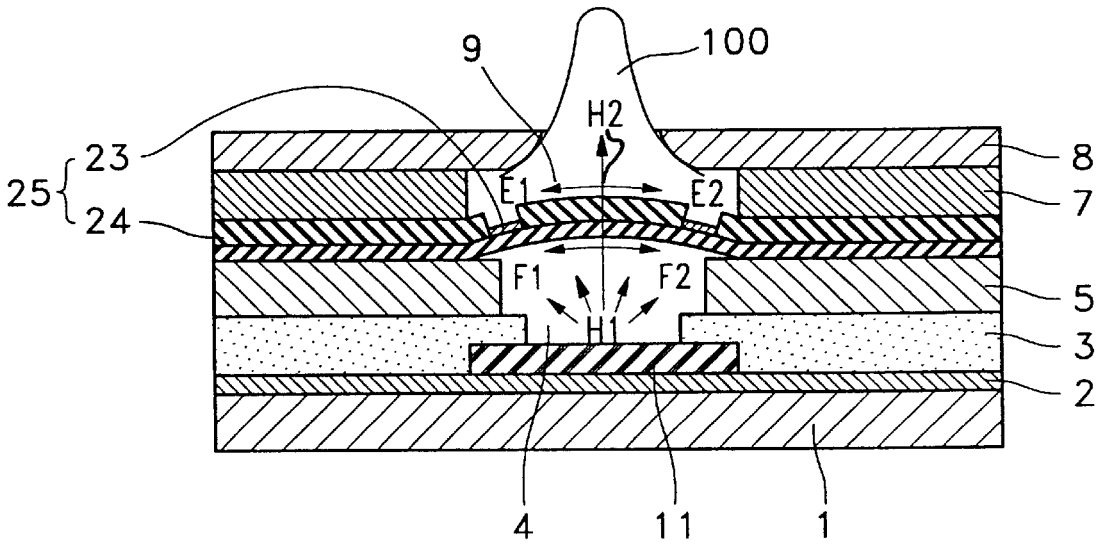

FIGS. 6 through 11 schematically illustrate the operation of the present invention. First, as shown in FIG. 6, an electrical signal outputted from electrode layer 3 is transmitted to heating layer 11. As a result, the electrical signal is converted into thermal energy and transmitted to heating chamber 4 formed thereon. Accordingly, the working liquid contained in heating chamber 4 is gasified and a predetermined vapor pressure is generated.

Figure 8:
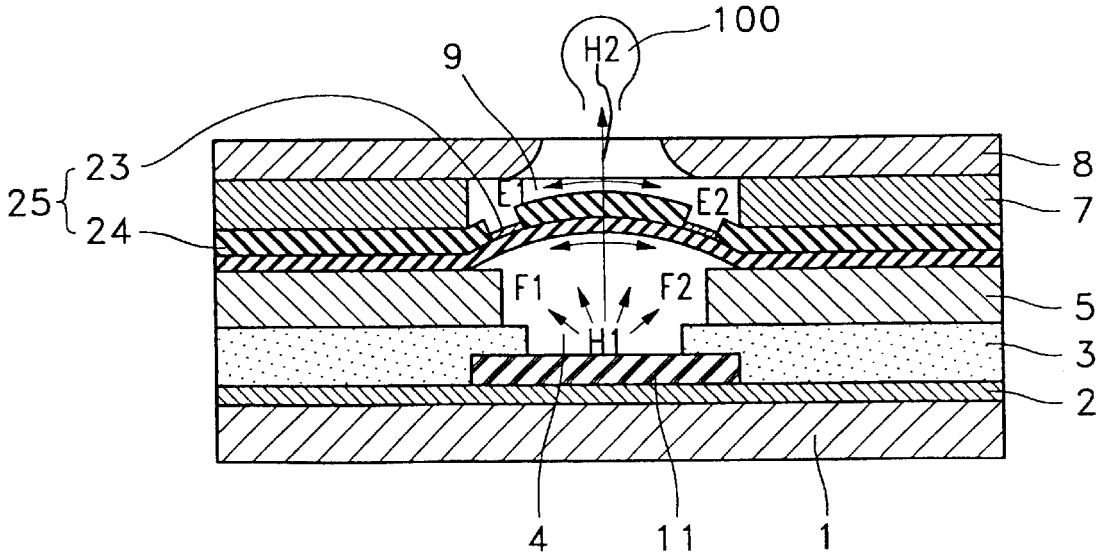

Then, oscillating layer 25 formed on the heating chamber 4 is expanded by the vapor pressure, becoming convex relative to heating chamber 4. Accordingly, ink fills ink chamber and begins to flow out through nozzle 10. The vapor pressure generated by the gasification of the working liquid progresses in the vertical direction with respect to oscillating layer 25 as indicated by the arrows H1 and H2 of FIGS. 6 and 7, and oscillating layer 25 is expanded in the horizontal direction as indicated by the arrows E1–E2 and F1–F2. In FIG. 8, ink 100 on oscillating layer 25 is shown in the state just before ink 100 is sprayed out of nozzle 10.

As noted, oscillating layer 25 is binarized into two layers. First expansion layer 24 is for transmitting a strong impact to ink 100 in the ink chamber 9 and second expansion layer 23 is for dispersing and removing the stress on first expansion layer 24. First expansion layer 24 has a larger mass per unit area than the second expansion layer 23.

Figure 12:
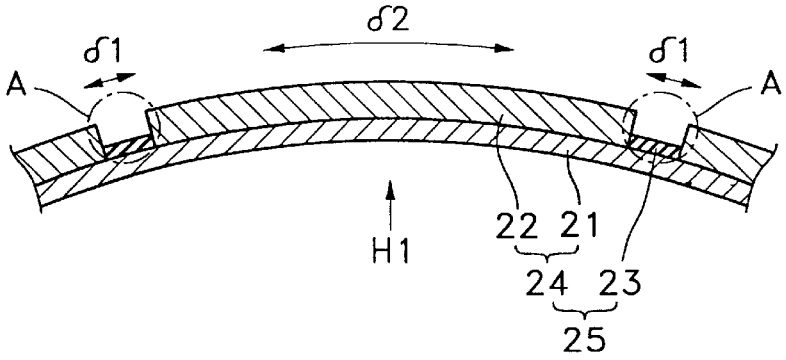
FIGS. 12 and 13 are schematic cross-sectional elevational views illustrating the movement of the oscillating layer during the practice of the present invention.

Accordingly, as shown in FIG. 12, first expansion layer 24 can transmit a strong impact to ink 100 in ink chamber 9 formed on first expansion layer 24 according to the impact transmission formula as given by P=mV, wherein P is an impact, m is the mass of a layer and V is the volume of the layer.

In addition, according to a feature of the present invention, second expansion layer 23 has a larger thermal expansion coefficient than first expansion layer 24. Accordingly, as shown in FIG. 12, stress 62 on first expansion layer 24 is transmitted to stress 61 on second expansion layer 23 and then appropriately dispersed and removed. In other words, oscillating layer 25 is designed so that its natural unstressed state is convex, as in FIG. 12, when oscillating layer 25 is heated, as during the expansion of the working fluid. The unstressed state itself is not used to drive the motion of osscillating layer 25, this motion being driven by the expansion of the working fluid. Rather, this convex unstressed state serves to compensate for the stress caused by flexing the membrane.

Figure 9:
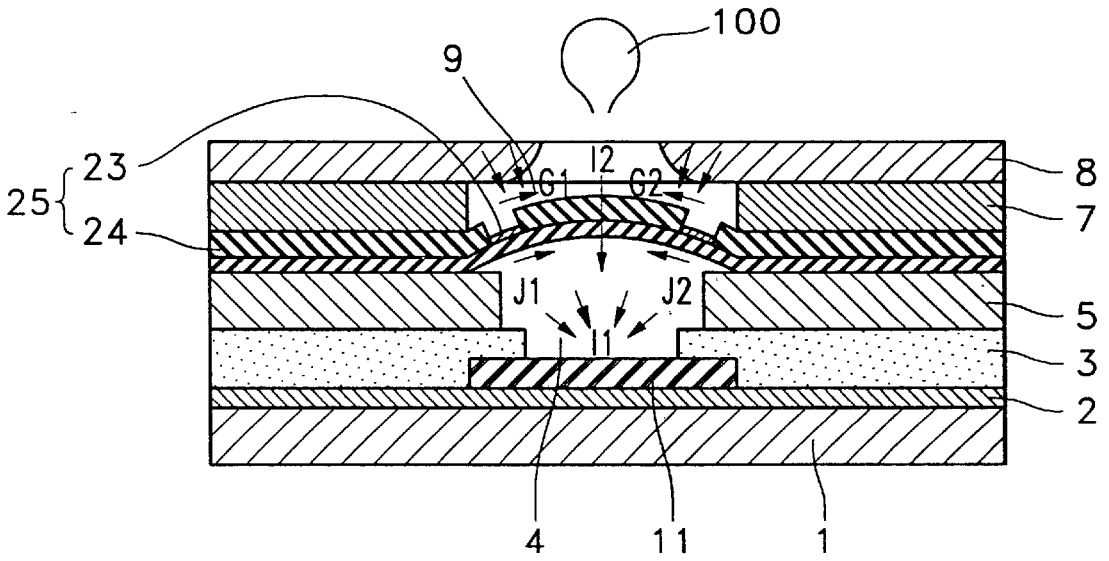
Figure 10:
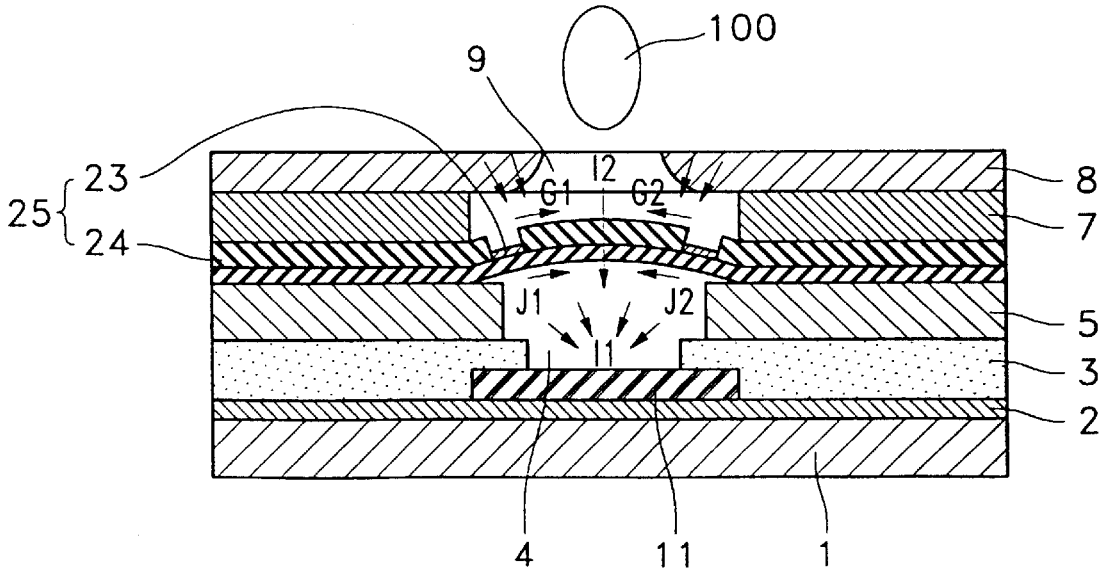
Figure 11:
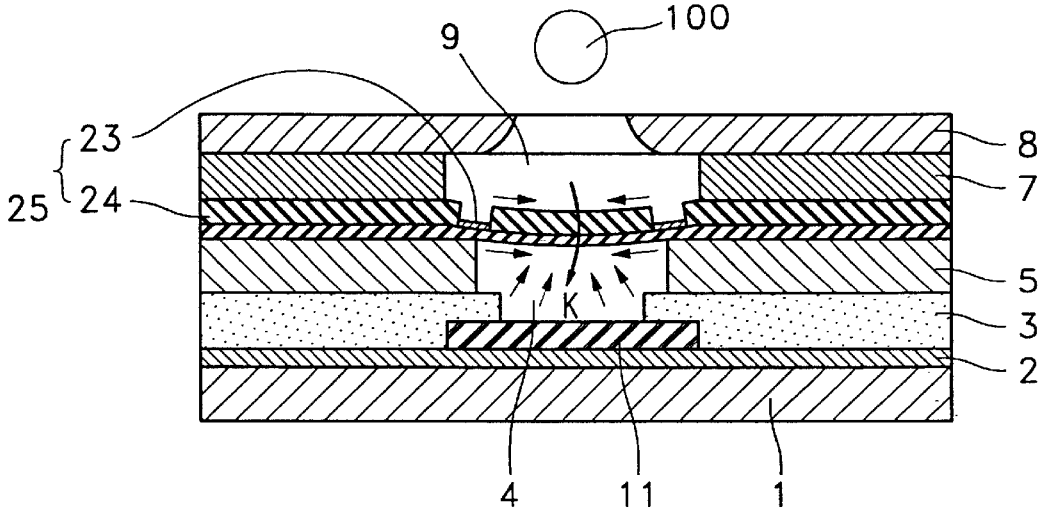

On the other hand, when the electrical signal outputted from electrode layer 3 is blocked off, shrinkage stresses G1–G2 and J1–J2 corresponding to the above-described expansion force are generated on oscillating layer 25 as indicated by the arrows of FIGS. 9, 10 and 11. Corresponding to the stress, shrinkage force J2–J1 and buckling power K are generated in ink chamber 9 and heating chamber 4 as indicated by the arrows.

Figure 13:
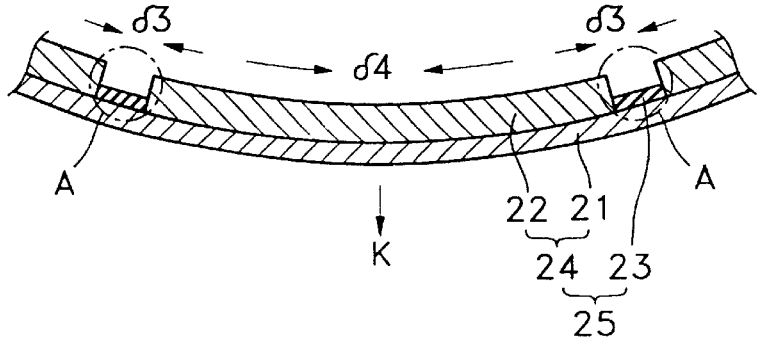

As mentioned, oscillating layer 25 is binarized into two layers. One is first expansion layer 24 for transmitting the impact to ink 100 in ink chamber 9; and the other is second expansion layer 23 for dispersing and removing the tensile stress on first expansion layer 24. Accordingly, as shown in FIG. 13, first expansion layer 24 of the present invention can transmit impact K to ink 100 in ink chamber 9 and second expansion layer 23 can receive shrinkage stress δ4 on first expansion layer 24 as shrinkage stress δ3 and then appropriately disperse and remove shrinkage stress δ3.

Then, as shown in FIGS. 10 and 11, oscillating layer 25 is flexed in the direction indicated by arrow K, concavely relative to heating chamber 100. Accordingly, ink 100 is transformed into a elliptical and circular shape and dropped outside, whereby an appropriate printing operation is performed on an external printing paper.

A method of manufacturing an ink-jet printer head according to the present invention is shown in schematic views FIGS. 14A through 14D, and FIGS. 15A through 15H are schematic views illustrating a method of manufacturing an oscillating layer assembly according to the present invention. As shown in FIGS. 14A through 14D, the method of manufacturing an ink-jet printer head according to the present invention includes the steps of assembling oscillating layer 25 preformed through a second process on a first assembly, an assembly of heating layer 11 and heating chamber barrier layer 5 pre-formed through a first process; and assembling a third assembly, an assembly of nozzle plate 8 and ink chamber barrier layer 7 pre-formed through a third process, on oscillating layer 25. The first process includes the steps of forming heating layer 11 on protective layer 2 which is formed on first substrate 1, and forming electrode layer 3 in contact with heating layer 11; and forming heating chamber barrier layer 5 on electrode layer 3 so as to define heating chamber 4 in contact with heating layer 11. The second process includes the steps of forming first expansion layer 24 on protective layer 201 on second substrate 200; patterning first expansion layer 24 to form grooves A in first expansion layer 24; and forming second expansion layer 23 in grooves A. The third process includes the steps of forming nozzle plate 8 including nozzle 10 protective layer 211 formed on third substrate 210; and forming ink chamber barrier layer 7 including ink chamber 9 on nozzle plate 8.

Figure 14A:
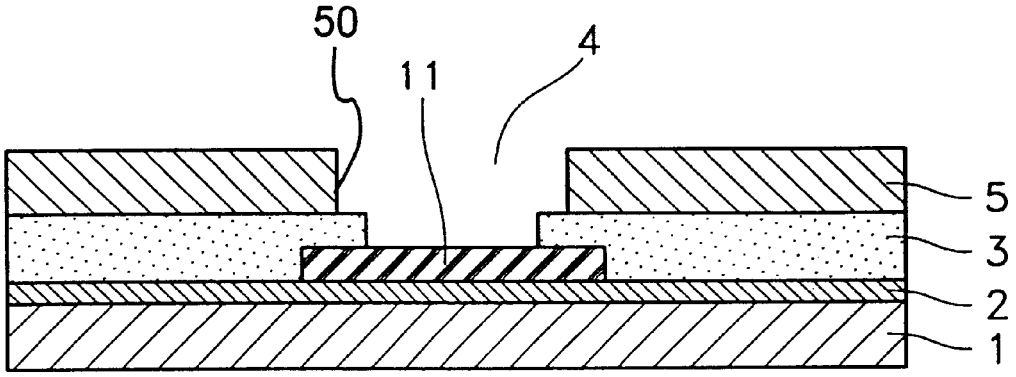
FIGS. 14A through 14D arc schematic cross-sectional elevational views illustrating a method of manufacturing an ink-jet printer head according to the principles of the present invention.

Looking at these steps in more detail, first, as shown in FIG. 14A, polysilicon is deposited on silicon substrate 1 including a protective layer of $SiO_2$ so that heating layer 11 is formed. Then, aluminum is deposited in contact with the heating layer 11 so that electrode layer 3 is formed. Heating layer 11 and the electrode layer 3 are patterned into appropriate shapes through a typical etching process.

Then, photopolymer is deposited on electrode layer 3 so as to form heating chamber barrier layer 5, defining heating chamber 4 in contact with heating layer 11. Heating chamber barrier layer 5 is patterned into an appropriate shape through the above-described typical etching process. This completes the first process, producing a heating layer and heating chamber barrier assembly.

Figure 14B:
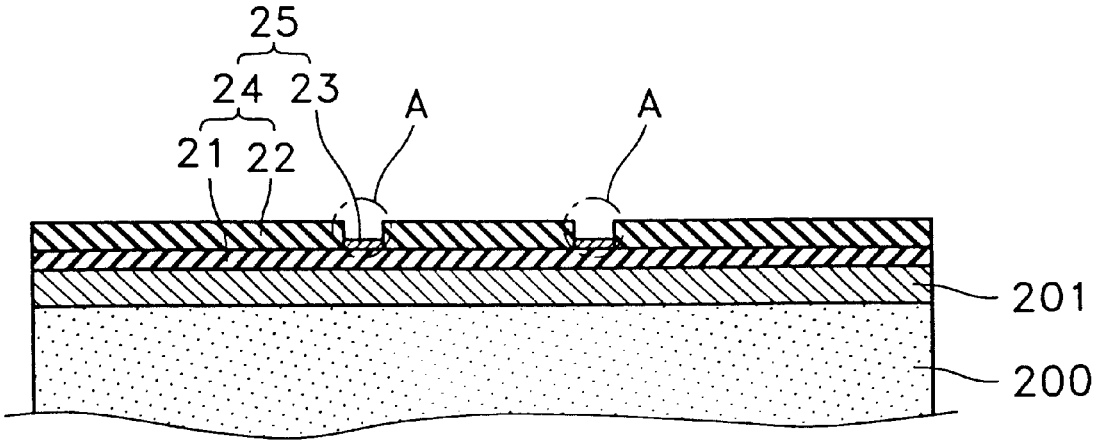

As shown in FIG. 14B, the second process for forming oscillating layer 25 is performed. As shown in FIGS. 15A through 15H, the second process of the present invention includes the steps of forming protective layer 201 on substrate 200 and forming first organic layer 21 on protective layer 201; forming first contact layer 22*a* on first organic layer 21, forming metal layer 22*b* on first contact layer 22*a* and forming second contact layer 22*c* on metal layer 22*b*; forming second organic layer 22*d* on second contact layer 22*c* and forming third contact layer 202 on second organic layer 22*d*; and patterning a structure of overlaying layers of first contact layer 22*a*, metal layer 22*b*, second contact layer 22*c*, second organic layer 22*d* and third contact layer 202 so as to form groove A and forming a second expansion layer 23 in the groove A. Accordingly, oscillating layer 25 of the present invention is binarized into first and second expansion layers 24 and 23 and appropriately manufactured.

Figure 15A:
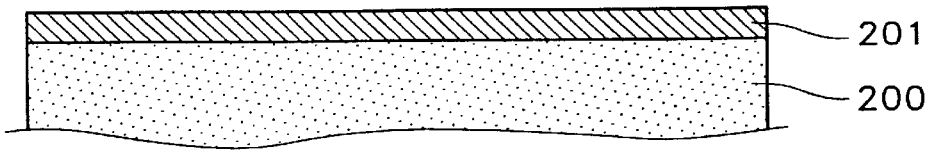
FIGS. 15A through 15H are schematic cross-sectional elevational views illustrating a method of manufacturing an oscillating layer according to the principles of the present invention.

The second process, producing an oscillating layer assembly, will be now be described in detail. First, as shown in FIG. 15A, protective layer 201 is formed on substrate 200 of silicon through a thermal oxidizing process so that substrate 200 can be prevented from being oxidized. Protective layer 201 has a composition of $SiO_2$.

Figure 15B:
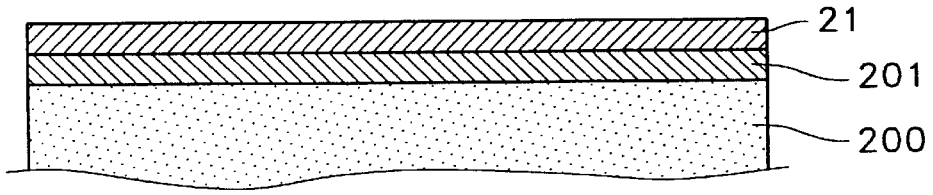

Thereafter, as shown in FIG. 15B, first organic layer 21, made of polyimide, is formed on protective layer 201. Preferably, first organic layer 21 is deposited to a thickness of 1.5 to 2 $\mu$m.

According to a feature of the present invention, first organic layer 21 is dry-treated at a temperature within a range of approximately 130 to 280° C. twice for a predetermined time interval. As a result, first organic layer 21 has a high toughness over its entire surface, whereby a condition for firm deposition of the first contact layer 22*a* which will be described later is obtained. Preferably, the dry-treating is performed twice at about 150° C. and about 200° C., respectively.

Figure 15C:
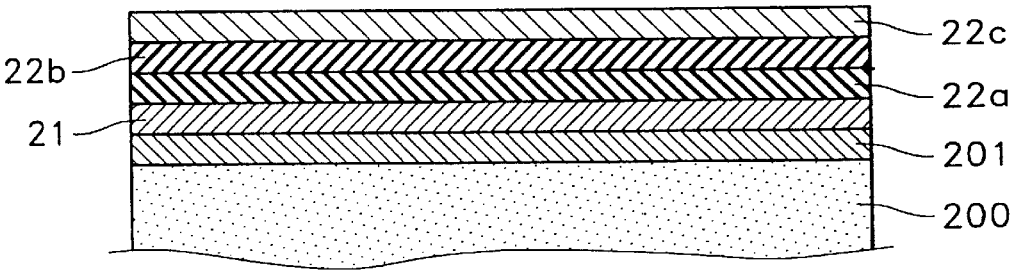

Then, as shown in FIG. 15C, first contact layer 22*a* of vanadium is formed on first organic layer 21. Preferably, first contact layer 22*a* is deposited to a thickness within a range of approximately 0.1 to 0.2 $\mu$m. More preferably, first contact layer 22*a* has a thickness of about 0.15 $\mu$m.

According to a feature of the present invention, first contact layer 22*a* has a surface resistance of within a range of approximately 180 to 220 $\Omega/cm^2$. More preferably, first contact layer 22*a* has a surface resistance of about 200 $\Omega/cm^2$.

Then, metal layer 22*b* of nickel is deposited on first contact layer 22*a* by sputtering or other process. According to a feature of the present invention, metal layer 22*b* is deposited to a thickness of within a range of approximately 0.2 to 0.5 $\mu$m. More preferably, metal layer 22*b* has a thickness of about 0.3 $\mu$m.

Preferably, the above-described metal layer 22*b* is vacuum-annealed at a temperature within a range of approximately 150 to 180° C. Accordingly, metal layer 22*b* has a high toughness over its entire surface, whereby a condition for firm deposition of second contact layer 22*c* which will be described later is obtained.

Continuously, second contact layer 22*c* of a material that is the same as the material of first contact layer 22*a* is deposited on metal layer 22*b*. Second contact layer 22*c* is deposited to a thickness of within a range of approximately 0.1 to 0.2 $\mu$m. More preferably, second contact layer 22*c* has a thickness of about 0.15 $\mu$m. In addition, the surface resistance of second contact layer 22*c* is the same as the surface resistance of first contact layer 22*a*, i.e., within a range of approximately 180 to 220 $\Omega/cm^2$, more preferably, about 200 $\Omega/cm^2$.

Figure 15D:
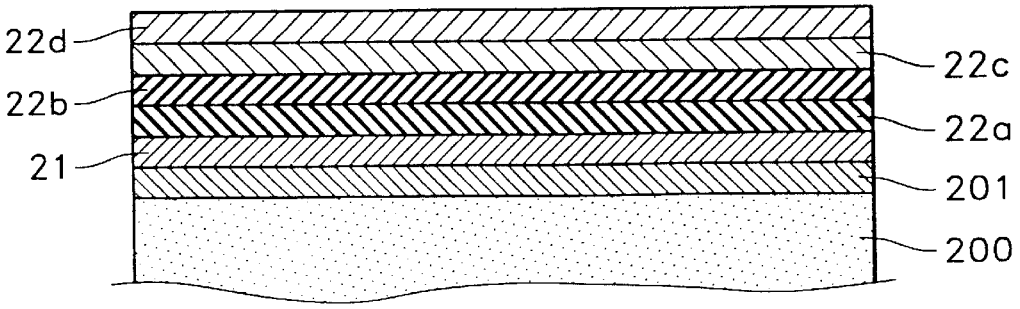

Thereafter, as shown in FIG. 15D, second organic layer 22*d* of a material that is the same as the material of first organic layer 21 is deposited on second contact layer 22*c*. Preferably, second organic layer 22*d* is deposited to a thickness within a range of approximately 2 to 4 $\mu$m. More preferably, second organic layer 22*d* has a thickness of about 3 $\mu$m.

Figure 15E:
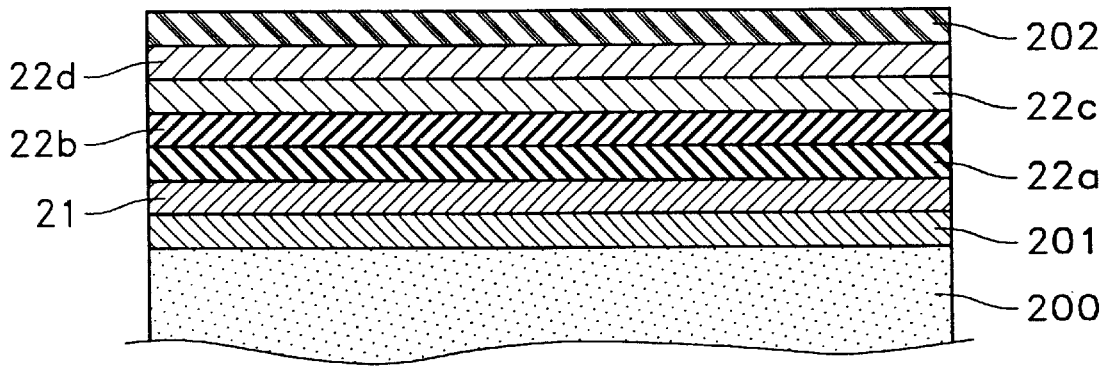

Then, as shown in FIG. 15E, third contact layer 202 having a high affinity for a photo resist 203 is deposited on second organic layer 22*d*. At this time, according to a feature of the present invention, third contact layer 202 has a overlying structure of chromium and copper, or has a single-layered structure of chromium or copper. Chromium and copper are generally known as materials having a high affinity for photoresist 203. Accordingly, photoresist 203 is firmly deposited on third contact layer 202 and then removed through a photolithography process so as to serve an appropriate function in formation of groove A which will be described later.

Preferably, third contact layer 202 is deposited to a thickness within a range of approximately 2 to 4 $\mu$m. More preferably, third contact layer 202 has a thickness of about 3 $\mu$m. In addition, the surface resistance of the third contact layer 202 is within a range of approximately 180 to 220 $\Omega/cm^2$. More preferably, surface resistance of the third contact layer 202 is about 200 $\Omega/cm^2$.

Figure 15F:
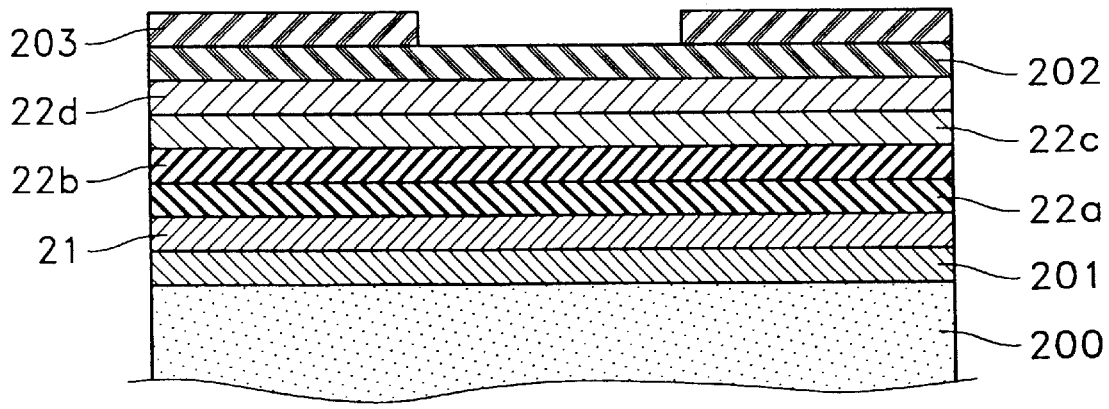
Figure 15G:
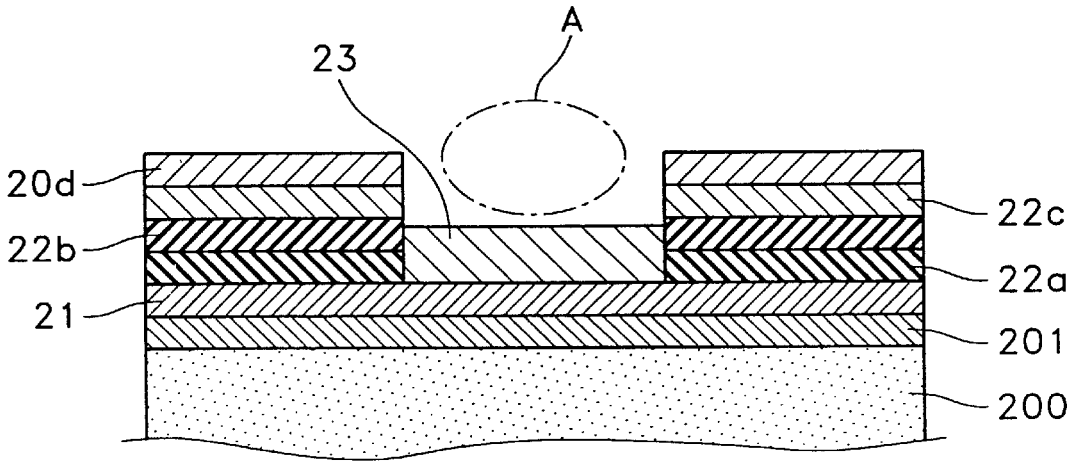
Figure 15H:
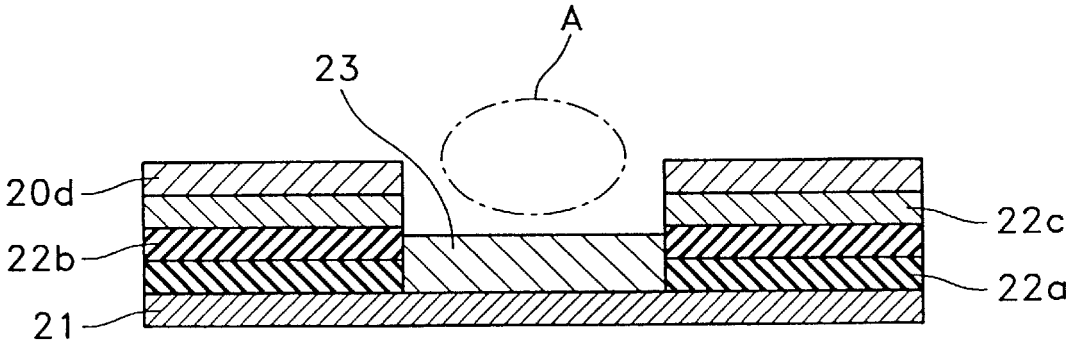

Continuously, as shown in FIG. 15F, photoresist 203 is coated on third contact layer 202. Then, a typical photolithography process is performed through photoresist 203 so as to form the pattern of groove A. Accordingly, as shown in FIG. 15G, first contact layer 22*a*, metal layer 22*b*, second contact layer 22*c*, second organic layer 22*d* and third contact layer 202 are appropriately etched. As a result, groove A is formed in the etched portion.

Thereafter, second expansion member 23 of polyimide is deposited in groove A. According to a feature of the present invention, second expansion layer 23 is deposited to a thickness of 1 to 3 $\mu$m. More preferably, second expansion layer has a thickness of 2 $\mu$m. Then, as shown in FIG. 15F, the above-described overlying layers are separated from substrate 200 to yield the oscillating layer assembly. This assembly is joined to the first assembly, the heating layer and barrier layer assembly to yield a joined lower assembly, in an assembling process that will be described hereinafter.

Figure 14C:
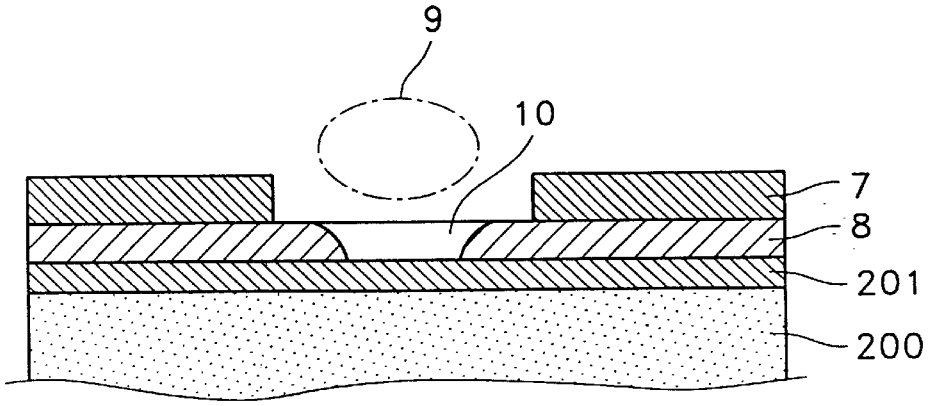

At the same time as the second process, the third process of the present invention is performed to produce a third assembly, a nozzle plate and liquid chamber barrier assembly. More particularly, first, as shown in FIG. 14C, nickel and the like are deposited on substrate 210 of silicon including protective layer 211 of $SiO_2$ so as to form nozzle plate 8. At this time, nozzle plate 8 is patterned through a typical etching process so that opening 10, i.e. a nozzle, is formed in nozzle plate 8.

Thereafter, polyimide is deposited on nozzle plate 8 so as to form ink chamber barrier layer 7. At this time, ink chamber barrier layer 7 is patterned through a typical etching process. As a result, ink chamber 9 having a predetermined inner space is formed by ink chamber barrier layer 7. Thereafter, the above-described overlying layers are separated from substrate 210 as a third assembly, and introduced into an assembling process that will be described hereinafter.

The respective overlying layers completed through the first, second and third processes are appropriately assembled through a predetermined adhering processes. Oscillating layer 25 that has been formed through the second process is joined to the first assembly, the assembly of heating layer and heating chamber barrier layer 5 that have been formed through the first process. The third assembly, the assembly of nozzle plate 8 and ink chamber barrier layer 7 that have been formed through the third process, is joined to the oscillating layer assembly, the oscillating layer assembly becoming oscillating layer 25.

Figure 14D:
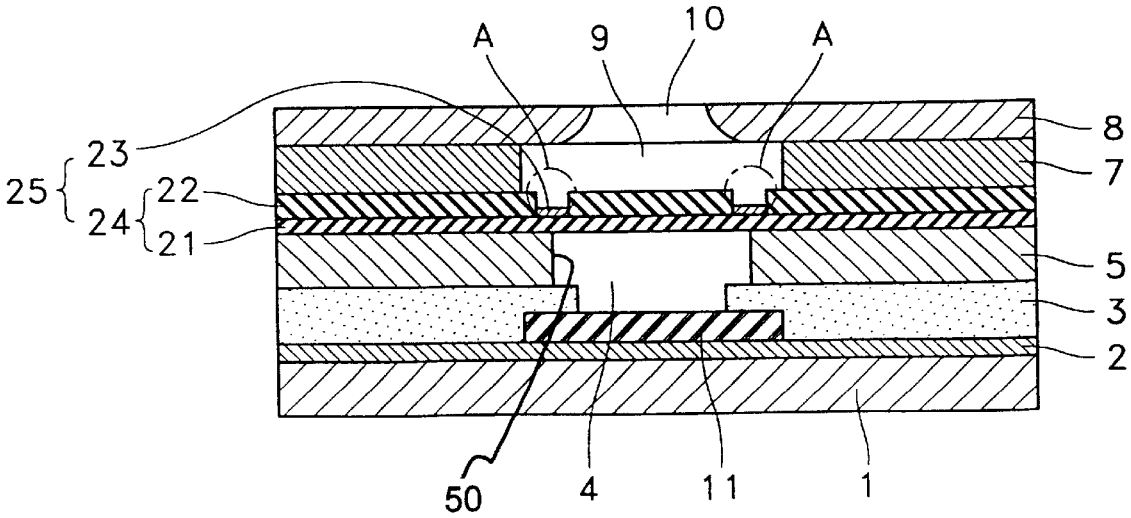

Accordingly, as shown in FIG. 14D, second expansion layer 23 of oscillating layer 25 is located on the edge portion of heating chamber 4 and ink chamber 9 is located on heating chamber 4 on the basis of first and second expansion layers 24 and 23. As a result, manufacturing of the ink-jet printer head of the present invention is completed.

As mentioned, in the present invention, the oscillating layer is binarized into two layers. One is the first expansion layer for transmitting expansion force and buckling power to the ink, and the other is the second expansion layer for dispersing and removing the stress on the first expansion layer, whereby transformation of a portion on which the stress is concentrated can be prevented in advance. As a result, the general printing operation of the printer head can be remarkably enhanced. The present invention can be applied to any micro-injection device fabricated through a processing line without any degradation of the efficiency.

Turning now to the methods of use of the present invention, this micro injector device can be used for the injection of small volumes of liquid in a variety of applications. The preferred method of use is in ink-jet printing. In this method, a plurality of units of the device would be formed into an array as part of an ink-jet printer head. Liquid chamber 9 would be filled with an ink, and the electrical impulses to the units would be controlled by a data-processing machine. Such a print head would be incorporated in a printer to print on paper, plastic, cloth or other medium accepting ink. Other possible media include a plate for use in offset printing.

Another method of use of the device could be injecting biologically active substances, such as drugs, into living organisms. For example, liquid chamber 9 could contain a drug to be administered slowly to the body. A unit could be worn on the skin or implanted in the body.

Another method of using the device could be administering liquids, such as lubricants, to machinery. For example, a machine requiring regular lubrication could have a unit of the invention containing oil in its liquid chamber incorporated into the machine.

Another method of use of the device could be in dispensing chemical reagents to chemical reactions. In particular, reactions performed on a small scale and requiring regular addition of reagents such as catalysts might be performed.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

As aforementioned, in the ink-jet printer head according to the present invention and a method form manufacturing the ink-jet printer head, the oscillating layer is binarized into two portions. One is a portion having a high thermal expandibility and the other is a portion having a high impact transmittability. Through the binarized portions, the resistance against stress and working response of the oscillating layer can be enhanced and thereby, the general printing performance thereof can be remarkably enhanced.

What is claimed is:

1. A micro-injection device, comprising:

a substrate;

a protective layer on said substrate;

a heating layer formed on said protective layer;

an electrode layer formed on said substrate and said heating layer, conducting electricity to the heating layer;

a heating chamber barrier layer formed on said electrode layer and said heating layer, defining a wall of a heating chamber;

a flexible oscillating layer formed on said heating chamber barrier layer and extending across said heating chamber, said oscillating layer defining a top of said heating chamber, said oscillating layer comprising:

a first expansion layer containing a grooved region; and a second expansion layer disposed in said grooved region of said first expansion layer;

a liquid chamber barrier layer formed on said oscillating layer and separated from said heating chamber by said oscillating layer, said liquid chamber barrier layer defining a liquid chamber; and a nozzle plate formed on said liquid chamber barrier layer, perforated by a nozzle and enabling communication between said liquid chamber and an environment external to said micro-injection device.

2. The device of claim 1, with said grooved region of said first expansion being disposed in alignment with said wall of said heating chamber barrier layer.

3. The micro-injection device of claim 2, with said first expansion layer having a larger mass per unit area than said second expansion layer.

4. The micro-injection device of claim 2, with said second expansion layer having a larger coefficient of thermal expansion than said first expansion layer.

5. The micro-injection device of claim 2, with said first expansion layer further comprising:

a first organic layer, made of an organic polymer;

a first contact layer formed on said first organic layer, by adhering to said first organic layer;

a metal layer formed on said first contact layer by adhering to said first contact layer;

a second contact layer formed on said metal layer, adhering to said metal layer; and a second organic layer formed on said second contact layer, said second organic layer being made of an organic polymer.

6. The micro-injection device of claim 5, where said first organic layer and said second organic layer are formed of polyimide.

7. The micro-injection device of claim 5, with said metal layer being formed of nickel.

8. The micro-injection device of claim 5, with each of said first contact layer and said second contact layer being formed of vanadium.

9. The micro-injection device of claim 5, with each of said first contact layer and said second contact layer being formed of titanium.

10. The micro-injection device of claim 5, with each of said first contact layer and said second contact layer being formed of chromium.

11. The micro-injection device of claim 2, with said second expansion layer being formed of an organic material.

12. The micro-injection device of claim 11, with said second expansion layer being formed of polyimide.

13. A method of manufacturing a micro-injection device, comprising the steps of:

making a first assembly, said first assembly comprising a heating layer and a heating chamber barrier layer formed on said heating layer;

making an oscillating layer assembly, where said oscillating layer assembly comprises:

a first expansion layer containing a grooved region, and a second expansion layer disposed in said grooved region of said first expansion layer;

making a third assembly, said assembly comprising a liquid chamber barrier and a nozzle plate formed on said liquid chamber barrier;

joining said oscillating layer assembly to said first assembly to create a joined lower assembly; and joining said third assembly to said joined lower assembly.

14. The method of claim 13, further comprising:

making said first assembly by:

forming a heating layer on a first substrate which has a protective layer;

forming an electrode layer in contact with said heating layer; and forming a heating chamber barrier layer on said electrode layer so as to define a heating chamber in contact with said heating layer;

making said oscillating layer assembly by:

forming a first expansion layer on a second substrate which has a protective layer;

patterning said first expansion layer so as to form grooved regions in said first expansion layer;

forming a second expansion layer in said grooved region; and making said third assembly by:

forming a nozzle plate including a nozzle on a third substrate which has a protective layer; and forming a liquid chamber barrier layer including a liquid chamber on said nozzle plate.

15. The method of claim 14, further comprising making said oscillating layer assembly by the steps of:

forming a protective layer on a substrate;

forming a first organic layer on said protective layer;

forming a first contact layer on said first organic layer;

forming a metal layer on said first contact layer;

forming a second contact layer on said metal layer;

forming a second organic layer on said second contact layer;

forming a third contact layer on said second organic layer;

patterning an overlying structure of said first contact layer, said metal layer, said second contact layer, said organic layer and said third contact layer so as to form a grooved region; and forming a second expansion layer in said grooved region.

16. The method of claim 15, with said first organic layer having a thickness within a range of approximately 1.5 to 2 $\mu$m.

17. The method of claim 15, with said first organic layer being dry-treated at a temperature within a range of approximately 130 to 280° C. several times for a time interval.

18. The method of claim 17, with said first organic layer being dry-treated two times.

19. The method of claim 15, with said first organic layer being dry-treated two times at about 150° C. and about 200° C., respectively.

20. The method of claim 15, with each of said first contact layer and said second contact layer having a thickness within a range of approximately 0.1 to 0.2 $\mu$m.

21. The method of claim 20, with each of said first contact layer and said second contact layer having a thickness of about 0.15 $\mu$m.

22. The method of claim 15, with said first contact layer and said second contact layer each having a surface resistance within a range of approximately 180 to 220 $\Omega/cm^2$.

23. The method of claim 22, with said first contact layer and said second contact layer each having a surface resistance of about 200 $\Omega/cm^2$.

24. The method of claim 15, with said metal layer having a thickness within a range of approximately 0.2 to 0.5 $\mu$m.

25. The method of claim 24, with said metal layer having a thickness of about 0.3 $\mu$m.

26. The method of claim 24, with said metal layer being vacuum-annealed.

27. The method of claim 26, with said vacuum-annealing being performed at a temperature within a range of approximately 150 to 180° C.

28. The method of claim 15, with said second organic layer having a thickness within a range of approximately 2 to 4 $\mu$m.

29. The method of claim 28, with said second organic layer having a thickness of about 3 $\mu$m.

30. The method of claim 15, with said third contact layer being formed as an overlying structure of chromium and copper.

31. The method of claim 15, with said third contact layer being formed of chromium.

32. The method of claim 15, with said third contact layer being formed of copper.

33. The method of claim 15, with said third contact layer having a thickness within a range of approximately 2 to 4 $\mu$m.

34. The method of claim 33, with said third contact layer having a thickness of about 3 $\mu$m.

35. The method of claim 33, with said third contact layer having a surface resistance within a range of approximately 180 to 220 $\Omega/cm^2$.

36. The method of claim 35, with said third contact layer having a surface resistance of about 200 $\Omega/cm^2$.

37. The method of claim 15, with said second expansion layer having a thickness within a range of approximately 1 to 3 $\mu$m.

38. The method of claim 37, with said second expansion layer having a thickness of about 2 $\mu$.

39. A method of using the micro-injection device of claim 2 for ink-jet printing, comprising the steps of:

forming a plurality of units of said device into an array as part of an ink-jet printer head; and controlling said array using a data-processing machine.

40. A method of using the micro-injection device of claim 2, comprising placing in said liquid chamber a biologically active fluid and implanting the device in the body of a mammal, to deliver said biologically active fluid to the mammal.

41. A method of using the micro-injection device of claim 2, comprising placing in said liquid chamber a biologically active fluid and placing the device on the skin of a mammal to deliver said biologically active fluid to the mammal.

42. A method of using the micro-injection device of claim 2, comprising placing in said liquid chamber a lubricant and incorporating the device as part of a machine to provide said lubricant to the machine.

43. A method of using the micro-injection device of claim 2, comprising placing in said liquid chamber a chemical reagent and using the device to dispense said chemical reagent to a vessel.

* * * * *